United States Patent [19]

McDevitt

[11] 4,019,032

[45] Apr. 19, 1977

[54] X-Y TO RANGE-BEARING CONVERTER

[75] Inventor: Edward J. McDevitt, Laurel, Md.

[73] Assignee: The United States of America as represented by the Secretary of the Navy, Washington, D.C.

[22] Filed: Jan. 14, 1976

[21] Appl. No.: 648,984

[52] U.S. Cl. ..... 235/150.5; 235/191

[51] Int. Cl.[2] ..... G06J 1/00

[58] Field of Search ..... 235/150.5, 186, 189–191

[56] References Cited

UNITED STATES PATENTS 3,952,187 4/1976 Robinson et al. ..... 235/189

*Primary Examiner*—R. Stephen Dildine, Jr.

[57] ABSTRACT

The present invention relates to an apparatus and method for converting an analog, two dimensional rectangular coordinate input into a digital output measured in range and bearing.

9 Claims, 7 Drawing Figures

| DECIMAL ADDRESS | BINARY ADDRESS $2^7$ | $2^6$ | $2^5$ | $2^4$ | $2^3$ | $2^2$ | $2^1$ | $2^0$ | ANALOG VALUE OF SIN α (LSB=0.039 VOLTS) | α IN BINARY EJM-2 $2^7$ | $2^6$ | $2^5$ | $2^4$ | EJM-1 $2^3$ | $2^2$ | $2^1$ | $2^0$ | α IN DEGREES |
|---|---|---|---|---|---|---|---|---|---|---|---|---|---|---|---|---|---|---|
| 0 | 0 | 0 | 0 | 0 | 0 | 0 | 0 | 0 | 0 0.0 0 0 0 | 0 | 0 | 0 | 0 | 0 | 0 | 0 | 0 | 0 0 |
| 1 | 0 | 0 | 0 | 0 | 0 | 0 | 0 | 1 | 0 0.0 3 9 0 | 0 | 0 | 0 | 0 | 0 | 0 | 0 | 0 | 0 0 |
| 2 | 0 | 0 | 0 | 0 | 0 | 0 | 1 | 0 | 0 0.0 7 8 0 | 0 | 0 | 0 | 0 | 0 | 0 | 0 | 0 | 0 0 |
| 3 | 0 | 0 | 0 | 0 | 0 | 0 | 1 | 1 | 0 0.0 1 7 0 | 0 | 0 | 0 | 0 | 0 | 0 | 0 | 0 | 0 0 |
| 4 | 0 | 0 | 0 | 0 | 0 | 1 | 0 | 0 | 0 0.1 5 6 0 | 0 | 0 | 0 | 0 | 0 | 0 | 0 | 0 | 0 0 |
| 5 | 0 | 0 | 0 | 0 | 0 | 1 | 0 | 1 | 0 0.1 9 5 0 | 0 | 0 | 0 | 0 | 0 | 0 | 0 | 1 | 0 1 |
| 6 | 0 | 0 | 0 | 0 | 0 | 1 | 1 | 0 | 0 0.2 3 4 0 | 0 | 0 | 0 | 0 | 0 | 0 | 0 | 1 | 0 1 |
| 7 | 0 | 0 | 0 | 0 | 0 | 1 | 1 | 1 | 0 0.2 7 3 0 | 0 | 0 | 0 | 0 | 0 | 0 | 0 | 1 | 0 1 |
| 8 | 0 | 0 | 0 | 0 | 1 | 0 | 0 | 0 | 0 0.3 1 3 0 | 0 | 0 | 0 | 0 | 0 | 0 | 0 | 1 | 0 1 |
| 9 | 0 | 0 | 0 | 0 | 1 | 0 | 0 | 1 | 0 0.3 5 2 0 | 0 | 0 | 0 | 0 | 0 | 0 | 1 | 0 | 0 2 |
| 10 | 0 | 0 | 0 | 0 | 1 | 0 | 1 | 0 | 0 0.3 9 0 0 | 0 | 0 | 0 | 0 | 0 | 0 | 1 | 0 | 0 2 |
| 11 | 0 | 0 | 0 | 0 | 1 | 0 | 1 | 1 | 0 0.4 3 0 0 | 0 | 0 | 0 | 0 | 0 | 0 | 1 | 0 | 0 2 |
| 12 | 0 | 0 | 0 | 0 | 1 | 1 | 0 | 0 | 0 0.4 6 9 0 | 0 | 0 | 0 | 0 | 0 | 0 | 1 | 0 | 0 2 |
| 13 | 0 | 0 | 0 | 0 | 1 | 1 | 0 | 1 | 0 0.5 0 8 0 | 0 | 0 | 0 | 0 | 0 | 0 | 1 | 0 | 0 2 |
| 14 | 0 | 0 | 0 | 0 | 1 | 1 | 1 | 0 | 0 0.5 4 7 0 | 0 | 0 | 0 | 0 | 0 | 0 | 1 | 1 | 0 3 |
| 15 | 0 | 0 | 0 | 0 | 1 | 1 | 1 | 1 | 0 0.5 8 6 0 | 0 | 0 | 0 | 0 | 0 | 0 | 1 | 1 | 0 3 |
| 16 | 0 | 0 | 0 | 1 | 0 | 0 | 0 | 0 | 0 0.6 2 5 0 | 0 | 0 | 0 | 0 | 0 | 0 | 1 | 1 | 0 3 |
| 17 | 0 | 0 | 0 | 1 | 0 | 0 | 0 | 1 | 0 0.6 6 4 0 | 0 | 0 | 0 | 0 | 0 | 0 | 1 | 1 | 0 3 |
| 18 | 0 | 0 | 0 | 1 | 0 | 0 | 1 | 0 | 0 0.7 0 3 0 | 0 | 0 | 0 | 0 | 0 | 1 | 0 | 0 | 0 4 |
| 19 | 0 | 0 | 0 | 1 | 0 | 0 | 1 | 1 | 0 0.7 4 2 0 | 0 | 0 | 0 | 0 | 0 | 1 | 0 | 0 | 0 4 |
| 20 | 0 | 0 | 0 | 1 | 0 | 1 | 0 | 0 | 0 0.7 8 1 0 | 0 | 0 | 0 | 0 | 0 | 1 | 0 | 0 | 0 4 |
| 21 | 0 | 0 | 0 | 1 | 0 | 1 | 0 | 1 | 0 0.8 2 0 0 | 0 | 0 | 0 | 0 | 0 | 1 | 0 | 0 | 0 4 |
| 22 | 0 | 0 | 0 | 1 | 0 | 1 | 1 | 1 | 0 0.8 5 9 0 | 0 | 0 | 0 | 0 | 0 | 1 | 0 | 0 | 0 4 |
| 23 | 0 | 0 | 0 | 1 | 0 | 1 | 1 | 1 | 0 0.8 9 8 0 | 0 | 0 | 0 | 0 | 0 | 1 | 0 | 1 | 0 5 |
| | | | | | | | | | ⋮ | | | | | | | | | |
| 109 | 0 | 1 | 1 | 0 | 1 | 1 | 0 | 1 | 0 4.2 5 8 0 | 0 | 0 | 0 | 1 | 1 | 0 | 0 | 1 | 2 5 |
| 110 | 0 | 1 | 1 | 0 | 1 | 1 | 1 | 0 | 0 4.2 9 7 0 | 0 | 0 | 0 | 1 | 1 | 0 | 0 | 1 | 2 5 |
| 111 | 0 | 1 | 1 | 0 | 1 | 1 | 1 | 1 | 0 4.3 3 6 0 | 0 | 0 | 0 | 1 | 1 | 0 | 0 | 1 | 2 5 |
| 112 | 0 | 1 | 1 | 1 | 0 | 0 | 0 | 0 | 0 4.3 7 5 0 | 0 | 0 | 0 | 1 | 1 | 0 | 0 | 1 | 2 5 |
| 113 | 0 | 1 | 1 | 1 | 0 | 0 | 0 | 1 | 0 4.4 1 4 0 | 0 | 0 | 0 | 1 | 1 | 0 | 1 | 0 | 2 6 |
| 114 | 0 | 1 | 1 | 1 | 0 | 0 | 1 | 0 | 0 4.4 5 3 0 | 0 | 0 | 0 | 1 | 1 | 0 | 1 | 0 | 2 6 |
| 115 | 0 | 1 | 1 | 1 | 0 | 0 | 1 | 1 | 0 4.4 9 2 0 | 0 | 0 | 0 | 1 | 1 | 0 | 1 | 0 | 2 6 |
| 116 | 0 | 1 | 1 | 1 | 0 | 1 | 0 | 0 | 0 4.5 3 1 0 | 0 | 0 | 0 | 1 | 1 | 0 | 1 | 0 | 2 6 |
| 117 | 0 | 1 | 1 | 1 | 0 | 1 | 0 | 1 | 0 4.5 7 0 0 | 0 | 0 | 0 | 1 | 1 | 0 | 1 | 1 | 2 7 |
| 118 | 0 | 1 | 1 | 1 | 0 | 1 | 1 | 1 | 0 4.6 0 9 0 | 0 | 0 | 0 | 1 | 1 | 0 | 1 | 1 | 2 7 |
| 119 | 0 | 1 | 1 | 1 | 0 | 1 | 1 | 1 | 0 4.6 4 8 0 | 0 | 0 | 0 | 1 | 1 | 0 | 1 | 1 | 2 7 |
| 120 | 0 | 1 | 1 | 1 | 1 | 0 | 0 | 0 | 0 4.6 8 8 0 | 0 | 0 | 0 | 1 | 1 | 0 | 1 | 1 | 2 7 |
| | | | | | | | | | ⋮ | | | | | | | | | |
| 170 | 1 | 0 | 1 | 0 | 1 | 0 | 1 | 0 | 0 6.6 4 0 0 | 0 | 0 | 1 | 0 | 1 | 0 | 0 | 1 | 4 1 |
| 171 | 1 | 0 | 1 | 0 | 1 | 0 | 1 | 1 | 0 6.6 8 0 0 | 0 | 0 | 1 | 0 | 1 | 0 | 0 | 1 | 4 1 |
| 172 | 1 | 0 | 1 | 0 | 1 | 1 | 0 | 0 | 0 6.7 1 9 0 | 0 | 0 | 1 | 0 | 1 | 0 | 1 | 0 | 4 2 |
| 173 | 1 | 0 | 1 | 0 | 1 | 1 | 0 | 1 | 0 6.7 5 8 0 | 0 | 0 | 1 | 0 | 1 | 0 | 1 | 0 | 4 2 |
| 174 | 1 | 0 | 1 | 0 | 1 | 1 | 1 | 0 | 0 6.7 9 7 0 | 0 | 0 | 1 | 0 | 1 | 0 | 1 | 0 | 4 2 |

FIG. 3A

| DECIMAL ADDRESS | BINARY ADDRESS $2^7$ | $2^6$ | $2^5$ | $2^4$ | $2^3$ | $2^2$ | $2^1$ | $2^0$ | ANALOG VALUE OF SIN α (LSB = 0.039 VOLTS) | α IN BINARY EJM-2 $2^7$ | $2^6$ | $2^5$ | $2^4$ | EJM-1 $2^3$ | $2^2$ | $2^1$ | $2^0$ | α IN DEGREES |
|---|---|---|---|---|---|---|---|---|---|---|---|---|---|---|---|---|---|---|
| 175 | 1 | 0 | 1 | 0 | 1 | 1 | 1 | 1 | 06.836 | 0 | 0 | 1 | 0 | 1 | 0 | 1 | 1 | 43 |
| 176 | 1 | 0 | 1 | 1 | 0 | 0 | 0 | 0 | 06.875 | 0 | 0 | 1 | 0 | 1 | 0 | 1 | 1 | 43 |
| 177 | 1 | 0 | 1 | 1 | 0 | 0 | 0 | 1 | 06.914 | 0 | 0 | 1 | 0 | 1 | 0 | 1 | 1 | 43 |
| 178 | 1 | 0 | 1 | 1 | 0 | 0 | 1 | 0 | 06.953 | 0 | 0 | 1 | 0 | 1 | 1 | 0 | 0 | 44 |
| 179 | 1 | 0 | 1 | 1 | 0 | 0 | 1 | 1 | 06.992 | 0 | 0 | 1 | 0 | 1 | 1 | 0 | 0 | 44 |
| 180 | 1 | 0 | 1 | 1 | 0 | 1 | 0 | 0 | 07.031 | 0 | 0 | 1 | 0 | 1 | 1 | 0 | 0 | 44 |
| 181 | 1 | 0 | 1 | 1 | 0 | 1 | 0 | 1 | 07.070 | 0 | 0 | 1 | 0 | 1 | 1 | 0 | 0 | 44 |
| 182 | 1 | 0 | 1 | 1 | 0 | 1 | 1 | 0 | 07.109 | 0 | 0 | 1 | 0 | 1 | 1 | 0 | 1 | 45 |
| 183 | 1 | 0 | 1 | 1 | 0 | 1 | 1 | 1 | 07.148 | 0 | 0 | 1 | 0 | 1 | 1 | 0 | 1 | 45 |
| 184 | 1 | 0 | 1 | 1 | 1 | 0 | 0 | 0 | 07.188 | 0 | 0 | 1 | 0 | 1 | 1 | 0 | 1 | 45 |
| ⋮ | | | | | | | | | | | | | | | | | | |
| 244 | 1 | 1 | 1 | 1 | 0 | 1 | 0 | 0 | 09.531 | 0 | 1 | 0 | 0 | 1 | 0 | 0 | 0 | 72 |
| 245 | 1 | 1 | 1 | 1 | 0 | 1 | 0 | 1 | 09.570 | 0 | 1 | 0 | 0 | 1 | 0 | 0 | 1 | 73 |
| 246 | 1 | 1 | 1 | 1 | 0 | 1 | 1 | 0 | 09.609 | 0 | 1 | 0 | 0 | 1 | 0 | 0 | 1 | 73 |
| 247 | 1 | 1 | 1 | 1 | 0 | 1 | 1 | 1 | 09.648 | 0 | 1 | 0 | 0 | 1 | 0 | 1 | 0 | 74 |
| 248 | 1 | 1 | 1 | 1 | 1 | 0 | 0 | 0 | 09.688 | 0 | 1 | 0 | 0 | 1 | 0 | 1 | 1 | 75 |
| 249 | 1 | 1 | 1 | 1 | 1 | 0 | 0 | 1 | 09.727 | 0 | 1 | 0 | 0 | 1 | 1 | 0 | 0 | 76 |
| 250 | 1 | 1 | 1 | 1 | 1 | 0 | 1 | 0 | 09.766 | 0 | 1 | 0 | 0 | 1 | 1 | 0 | 1 | 77 |
| 251 | 1 | 1 | 1 | 1 | 1 | 0 | 1 | 1 | 09.805 | 0 | 1 | 0 | 0 | 1 | 1 | 1 | 0 | 78 |
| 252 | 1 | 1 | 1 | 1 | 1 | 1 | 0 | 0 | 09.844 | 0 | 1 | 0 | 0 | 1 | 1 | 1 | 1 | 79 |
| 253 | 1 | 1 | 1 | 1 | 1 | 1 | 0 | 1 | 09.883 | 0 | 1 | 0 | 1 | 0 | 0 | 0 | 0 | 80 |
| 254 | 1 | 1 | 1 | 1 | 1 | 1 | 1 | 0 | 09.922 | 0 | 1 | 0 | 1 | 0 | 0 | 1 | 1 | 83 |
| 255 | 1 | 1 | 1 | 1 | 1 | 1 | 1 | 1 | 09.961 | 0 | 1 | 0 | 1 | 0 | 1 | 0 | 1 | 85 |

ROM TABLE EXTENSION

FIG. 3B

X-Y TO RANGE-BEARING CONVERTER

BACKGROUND OF THE INVENTION

Most prior art hardware approaches for converting an X-Y position voltage into corresponding range and bearing readings have employed modulators to produce signals that yield a phase angle from which the bearing can be determined. These approaches have generally been exclusively analog, relying on conventional clamping and chopper circuits to obtain bearing output. A number of these techniques have utilized successive approximation methods requiring numerous feedback and comparison networks which slow down and complicate the converter circuitry. Further, such prior art analog approaches have lacked the versatility, reliability, and adaptability which a digitally designed converter would provide.

It is, therefore, an object of the present invention to convert analog rectangular coordinate inputs into digital range and bearing (polar) form in a simple, highly reliable fashion without using valuable computer time.

It is a further object of the present invention to examine the operational signs of the analog inputs to determine into which quadrant the bearing belongs and to provide multiplexing circuitry for appropriately channeling angle information to produce a bearing output located in the proper quadrant.

SUMMARY OF THE INVENTION

The present invention is divided into two sections: one for range, R, and the other for bearing, $\theta$. Range, R, is determined by sending $x$- and $y$- inputs into a vector module, converting the analog output to digital, and processing the digital readout. The bearing calculation is accomplished by checking the signs of $x$ and $y$ and determining a trigonometric value derived from $x$ and $y$ (including $R = \sqrt{x^2+y^2}$) which can be fed into a Read Only Memory (ROM) and selective adder that convert the trigonometric value into an angle $\alpha'$, ranging between 0° and 90°. The signs of $x$ and $y$ indicate in which quadrant the angle $\alpha'$ is. If $x$ and $y$ are positive, for example, $\alpha'$ is in the first quadrant. If $x$ is positive and $y$ is negative $\alpha'$ is in the second quadrant and so on. Multiplexing circuitry is employed which adds to or subtracts from $\alpha'$ the appropriate number of degrees to give $\theta$. For example, if $\alpha' = 15°$ and $x$ and $y$ are negative ($\alpha'$ is in the third quadrant) the multiplexing circuitry will cause 180° to be added to $\alpha'$ to give $\theta = 15° + 180° = 195°$.

BRIEF DESCRIPTION OF THE DRAWINGS

FIGS. 3A and 3B are a truth table for coding the Read Only Memory provided in the invention.

DESCRIPTION OF THE PREFERRED EMBODIMENT

Figure 1:
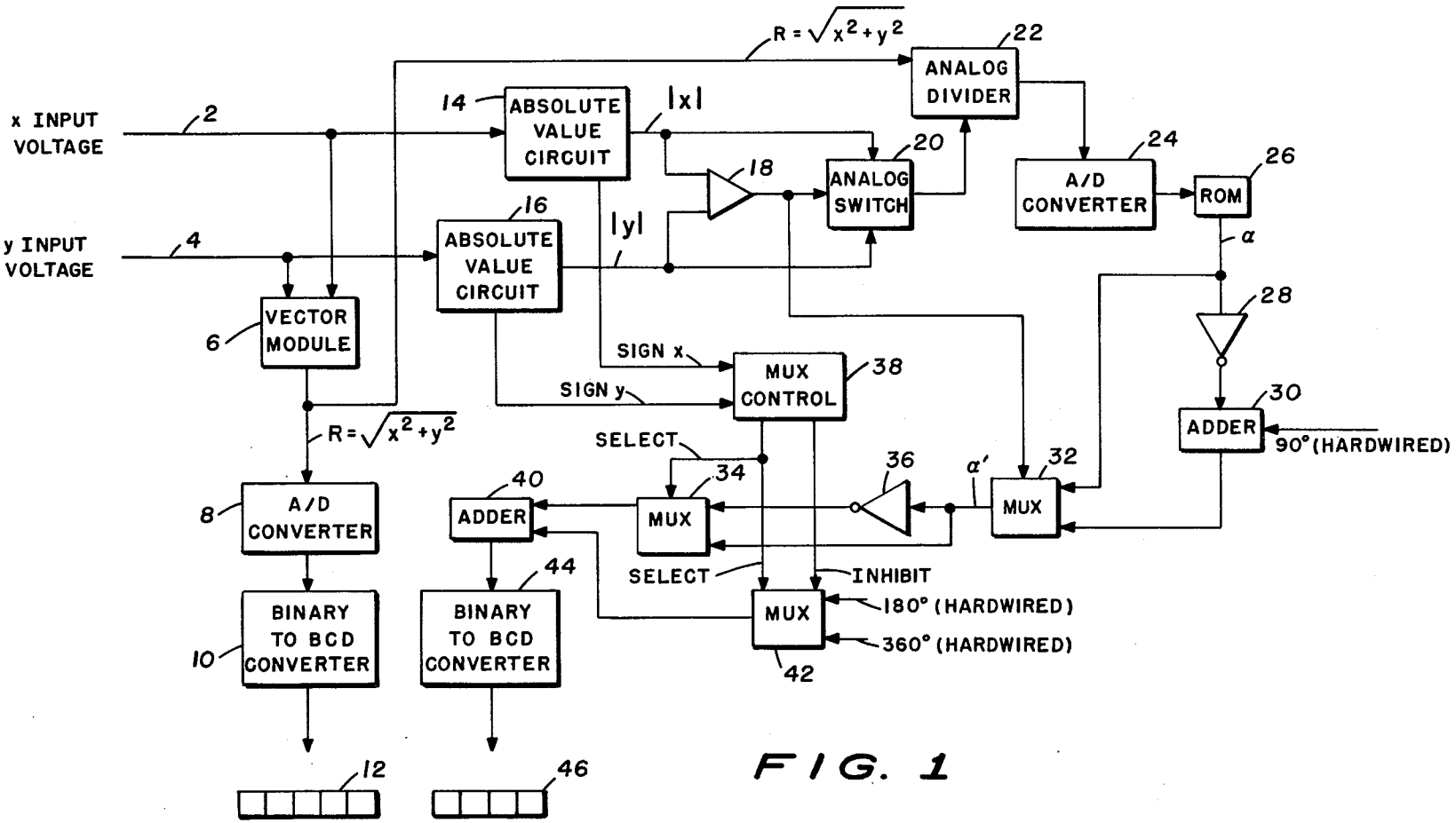
FIG. 1 is a block diagram representation of the present invention.

Referring to FIG. 1, two rectangular coordinate analog voltage inputs, an $x$ input 2 and a $y$ input 4, are shown. In determining range, R, a conventional vector module 6 is employed which operates on $x$ input 2 and $y$ input 4 to produce a voltage equal to $\sqrt{x^2+y^2}$. This output voltage represents R in analog form. By sending the output voltage through an analog-to-digital (A/D) converter 8, R is transformed into digital form. A/D converter 8 converts the output voltage from vector module 6 into a 12-bit binary code with the least significant bit being equal to about one-eighth (⅛) of a mile. The 12-bit binary is then converted into four decades of Binary Coded Decimal (BCD) by a Binary-to-BCD converter 10. R is then displayed on a range read-out display 12 which may be of the light-emitting diode (LED) variety.

Figure 2A:
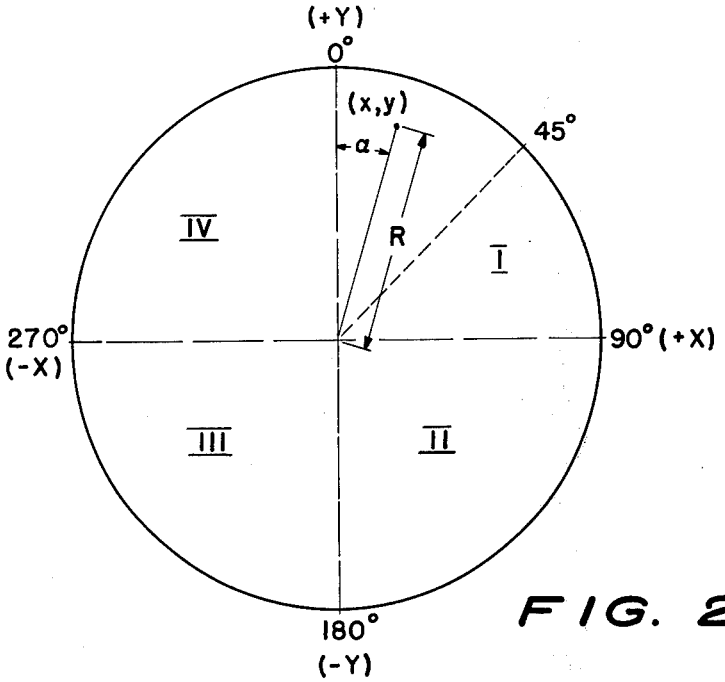
FIGS. 2A, 2B, and 2C are graphic representations showing two separate positions on a radar display.
Figure 2B:
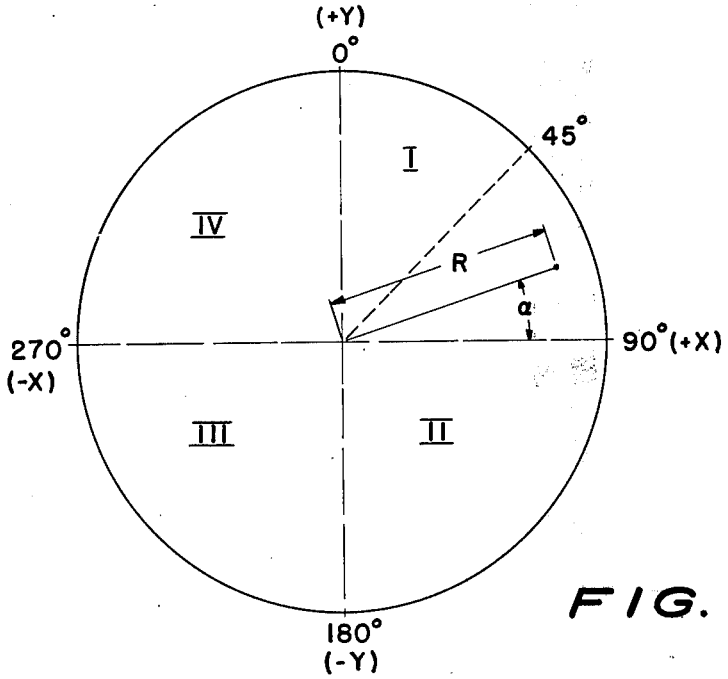
Figure 2C:
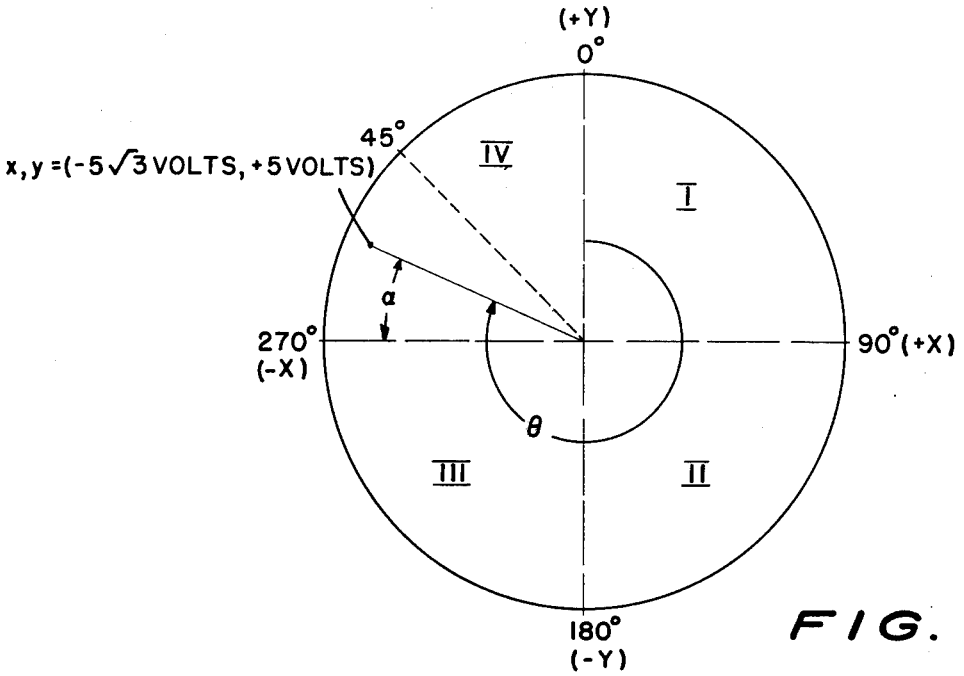

In determining bearing, $\theta$, according to the preferred embodiment, the $x$ input 2 and $y$ input 4 are fed into an absolute-value-of-$x$ circuit 14 and an absolute-value-of-$y$ circuit 16, respectively. The absolute value circuits of each produce a sign output (labelled SIGN $x$ and SIGN $y$ in FIG. 1) and a magnitude (or absolute value) output (labelled $|x|$ and $|y|$ in FIG. 1). The magnitude output $|x|$ from the absolute-value-of-$x$ circuit 14 is compared to the magnitude output $|y|$ from the absolute-value-of-$y$ circuit 16 in a voltage comparator 18. The output from voltage comparator 18 is the lesser of the two magnitude input $|x|$ and $|y|$. An analog switch 20, receiving $|x|$ and $|y|$ as inputs, is connected to the output of voltage comparator 18 which causes analog switch 20 to pass through the lesser magnitude output $|x|$ or $|y|$. The lesser magnitude output $|x|$ or $|y|$ is then fed to an analog divider 22 where it is read as the dividend input. The divisor input to analog divider 22 is the output voltage equal to $\sqrt{x^2+y^2}$ coming from vector module 6. The output of analog divider 22 is either $|x| / \sqrt{x^2+y^2}$ or $|y| / \sqrt{x^2+y^2}$, whichever is less. This output may be viewed trigonometrically as sin $\alpha$, where $\alpha \leq 45°$. The sin $\alpha$ output is digitized by an A/D converter 24 which transforms the analog voltage representing sin $\alpha$ into a corresponding digital value. The digital value of sin $\alpha$ is then fed into a Read Only Memory (hereafter referred to as ROM) 26 which performs the inverse sine function yielding an output $\alpha = \mathrm{Sin}^{-1}(x / \sqrt{x^2+y^2})$ where $|x| < |y|$ and $\alpha = \mathrm{Sin}^{-1}(y / \sqrt{x^2+y^2})$ where $|y| < |x|$. As shown in FIGS. 2A, 2B and 2C the value of $\alpha$, according to the preferred embodiment is always within the limits $0 < \alpha < 45°$. In FIG. 2A, $|x| < |y|$ and analog switch 20 passes through $|x|$ with analog divider 22 producing an output $|x| / \sqrt{x^2+y^2}$; angle $\alpha = \mathrm{Sin}^{-1} |x| / \sqrt{x^2+y^2})$ is less than 45° as illustrated. In FIG. 2B $|y| < |x|$ and analog switch 20 passes through $|y|$ thereby producing an output $|y| / \sqrt{x^2+y^2}$ from analog divider 22; $\alpha = \mathrm{Sin}^{-1}(|y| / \sqrt{x^2+y^2})$ in this case is again less than 45°. Finally, in FIG. 2C $|y| < |x|$ and angle $\alpha$ is again shown to be less than 45°.

The purpose for limiting $\alpha$ to 45° is related to the hardware involved. As the trigonometric sine approaches 90°, the resolution in the conversion is greatly diminished. Referring to the table of FIG. 3, the analog sin $\alpha$ output to A/D converter 24 (of FIG. 1) is shown with a corresponding $\alpha$ shown in binary and in degrees. The addresses (available in the ROM) are shown in decimal and binary notation, thereby describing the manner in which the ROM is wired according to the preferred embodiment. From the table it can be seen that between 0° and 45° small increments (decrements) of sin $\alpha$ result in very small increments (decrements) in $\alpha$. That is, a one bit (i.e., .039 volt) increment (decrement) in the sin $\alpha$ output results in a 1/5 to ⅓ of 1° increment (decrement) in $\alpha$. On the other hand, examining the extension to the table of FIG. 3 showing $\alpha$ ranging up to 90°, it is readily apparent that small changes in sin $\alpha$ cause comparatively large changes in $\alpha$ when $\alpha$ approaches 90°. Instead of the 1/5 of 1° increment (decrement) in $\alpha$ per one bit (0.039 volt) increment (decrement) of sin $\alpha$ in the 0° to 45° range, there is (near 90°) a 3° increment (decrement) per one bit increment (decrement) in sin $\alpha$. This loss of resolution creates an unacceptable margin of error among the higher $\alpha$ values. To overcome the above-described loss of resolution, $\alpha$ was limited to the range between 0° and 45° by evaluating the sine as the lesser value $|x| / \sqrt{x^2+y^2}$ or $|y| / \sqrt{x^2+y^2}$. It should, however, be noted that ROM 26 has the capacity to handle a range of from 0° to 85° as seen in FIG. 3. It is for the sake of maximizing resolution that the 45° limit is imposed.

From ROM 26, the binary value of $\alpha$ is transmitted along two paths. Along the first path, the binary value of $\alpha$ is sent through an inverter 28 and then an adder 30 wherein the binary equivalent of 90° is added to the inverted value of $\alpha$. The output of adder 30 is then $(90° - \alpha)$. The $(90° - \alpha)$ signal and the second path of the binary value of $\alpha$ enter a multiplexer (MUX) 32. MUX 32 receives a third input from voltage comparator 18 which informs MUX 32 of which magnitude input $x$ or $|y|$ is smaller. If $|x|$ is smaller, MUX 32 produces a first angle output $\alpha' = \alpha$; if $|y|$ is smaller than or equal to $|x|$, MUX 32 produces a first angle output $\alpha' = (90° - \alpha)$. MUX 32 output $\alpha'$ thus measures an angle ranging between 0° and 90°.

The output of $\alpha'$ is then fed (as a positive (+) first angle output $\alpha'$) into another multiplexer (MUX) 34. The $\alpha'$ output is also fed into an inverter 36 which inverts $\alpha'$ thereby producing a negative (−) first angle output, $-\alpha'$, and feeds $-\alpha'$ as the second input to MUX 34. MUX 34 produces a signal $\alpha'$ or $-\alpha'$. Which of these two values is selected is determined by a multiplex (MUX) control 38. MUX control 38 receives the aforementioned operational sign outputs, SIGN $x$ and SIGN $y$, from the $x$ and $y$ absolute value circuits 14 and 16, respectively. The values of SIGN $x$ and SIGN $y$ determine in which quadrant the bearing is located. (Referring to FIGS. 2A, 2B, and 2C the quadrants are shown with the first quadrant, I, representing the 12 o'clock to 3 o'clock quadrant; the second quadrant, II, representing 3 to 6; the third quadrant, III, representing 6 to 9; and the fourth quadrant, IV, representing 9 o'clock to 12 o'clock quadrant. This clockwise numbering of the quadrants starting at 12 o'clock corresponds to the normal radar sweep). If SIGN $x$ and SIGN $y$ indicate positive values for $x$ and $y$, the bearing is "placed" in the first quadrant. If SIGN $x$ indicates a positive $x$ value while SIGN $y$ indicates a negative $y$ value, the bearing is "placed" in the second quadrant. A negative SIGN $x$ and negative SIGN $y$ indication "places" the bearing in the third quadrant. Finally, a negative SIGN $x$ value and a positive SIGN $y$ value indication "places" the bearing in the fourth quadrant.

To "place" the bearing in the proper quadrant the MUX control 38 performs two operations. First, if SIGN $x$ and SIGN $y$ values indicate bearing in the first or third quadrant, MUX 34 has an output equal to $\alpha'$; if the bearing is in the second or fourth quadrant, MUX 34 has a $-\alpha'$ output. The output from MUX 34 enters an adder 40. Second, MUX control 38 also controls another multiplexer 42 which has input wires corresponding to 180° (in binary) and 360° (in binary). MUX control 38 also has a SELECT line which turns ON the 180° wire when a bearing in the second or third quadrant is indicated and turns ON a 360° wire when a fourth quadrant bearing is indicated; an INHIBIT line is also provided which can suppress both the 180° wire and the 360° wire and inhibits the output of MUX 42 when a first quadrant bearing is indicated. The output from MUX 42 (if there is one) enters adder 40 together with the output from MUX 34 to produce a final binary bearing output. This binary bearing output can be fed into a binary-to-BCD converter 44 to be read out on some output display 46.

By way of example, the range and bearing of the X-Y coordinate position shown in FIG. 2C will be determined with reference to the apparatus in FIG. 1. Letting the maximum $|x|$ and $|y|$ input voltages be +10 volts and, for this example, letting $x = -5\sqrt{3}$ volts and $y = 5$ volts, a comparison in voltage comparator 18 of $|x|$ and $|y|$ indicates that $|y| < |x|$. ROM 26, thereafter, finds $\alpha = 30°$ from $\text{Sin}^{-1}\, 5/\sqrt{[5^2 + 25(3)]} = \text{Sin}^{-1}(½)$. MUX 32, which receives inputs corresponding to $\alpha$ and $(90° - \alpha)$, selects the $(90° - \alpha)$ value as its output due to the signal received by MUX 32 from voltage comparator 18, i.e., $|y| < |x|$; $\alpha'$ is selected as $(90° - 30°) = 60°$. At this point, MUX control 38 determines that the bearing is in the fourth quadrant because SIGN $x$ indicates a negative value for $x$ while SIGN $y$ indicates a positive value for $y$. MUX 32 passes $-\alpha'$, or $-60°$, (in binary) to adder 40 while MUX 42 passes 360° (in binary) to adder 40. The output from adder 40 is 360° (in binary) plus minus 60° (in binary) or 300° which an inspection of FIG. 2C verifies.

Figure 4:
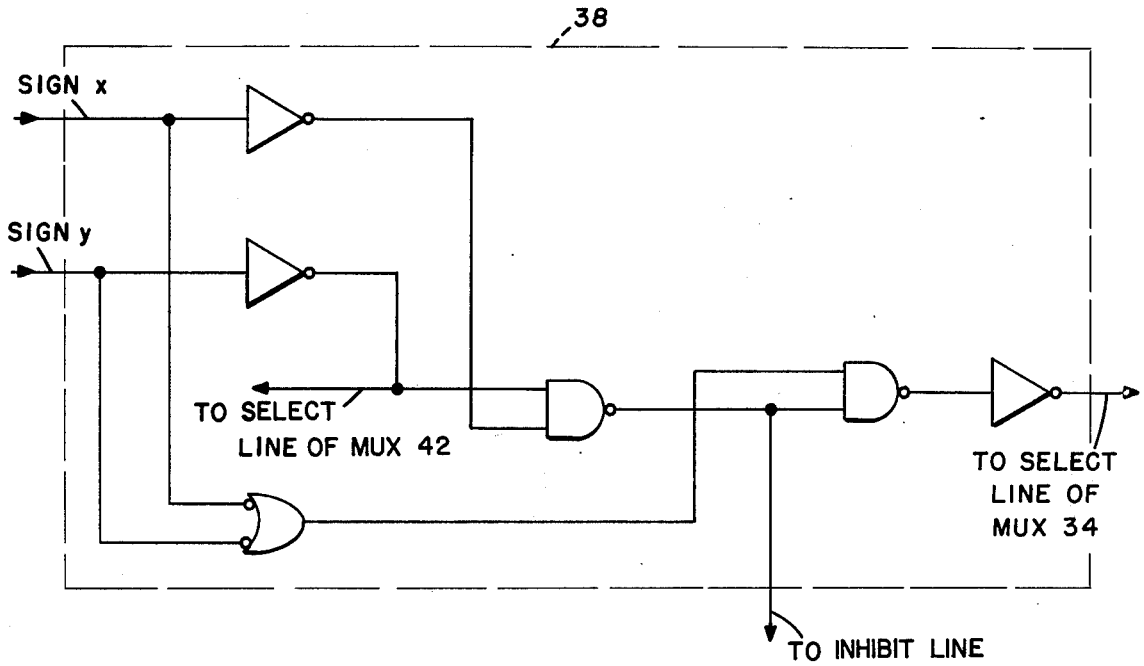
FIG. 4 is a circuit diagram showing elements which can comprise the Multiplex control of the present invention.

The elements comprising the present invention are conventional components and integrated circuit (IC) chips available commercially. For example, ROM 26 may be of the INTERSIL IN 5623 CDS type comprising an EJM-1-ROM connected to an EJM-2-ROM. A/D converters may be of the DATEL ADC-EH-1 type while the MUX's may comprise SN 74157 IC chips. MUX control 38 may comprise a simple INVERTER-AND-OR network of elements as shown in FIG. 4.

As previously mentioned the present invention extends beyond the preferred embodiment sine mode and includes trigonometric modes such as the cosine, tangent, and other related angle functions, all of which require only slight modifications which may be readily fashioned once an understanding of the preferred embodiment is acquired. To be sure, the invention using the cosine mode would be only a trivial variation of the described preferred embodiment. Using the tangent function might require more hardware memory to obtain resolution comparable to the sine embodiment and would require a comparison of $|y|$ to $|x|$ (rather than the less of $|x|$ or $|y|$ to R); however, the basic features of the present invention would remain unchanged.

The invention further contemplates the adaptation of the circuitry and principles of the present invention in three dimensional applications where height angle may be determined in the manner employed in determining bearing.

The remaining elements comprising the present invention are conventional and well-known in the art.

Various other modifications, adaptations and alterations are, of course, possible in light of the above teachings. Therefore, it should be understood that, within the scope of the appended claims, the invention may be practiced otherwise than as specifically described.

What is claimed is:

1. A method for converting two rectangular coordinate analog inputs into range and bearing digital outputs, comprising the steps of:

producing an analog range output from said analog inputs and digitizing the analog range output in an analog-to-digital circuit, producing by circuit means a digital trigonometric value calculated with said two analog inputs, feeding the digital trigonometric value into a read-only memory and producing a first angle output, corresponding to said trigonometric value, comparing the signs of the rectangular coordinate analog inputs to determine into which quadrant the first angle output belongs, and sending the sign comparison output and the first angle output into bearing multiplexer circuitry, and changing the value of the first angle output into a bearing output positioned in the proper quadrant as determined by the inputs sent into the bearing multiplexer circuitry.

2. A method for converting two rectangular coordinate analog inputs into range and bearing digital outputs as defined in claim 1 wherein the production of the digital trigonometric value comprises the steps of:

selecting one of the two analog inputs in a switching circuit, evaluating the absolute value of the selected analog input in an absolute value circuit, dividing the absolute value of the selected analog input by the analog range output in an analog divider, and digitizing the value produced by the analog divider.

3. A method for converting two rectangular coordinate analog inputs into range and bearing digital outputs as defined in claim 1, comprising the further steps of:

converting the digital range and bearing output into decimal form.

4. A method of converting two rectangular coordinate analog inputs into range and bearing digital outputs as defined in claim 1, comprising the further steps of:

evaluating the absolute value of the first and second analog inputs in absolute value circuitry, comparing the absolute value of the first analog input with the absolute value of the second analog input in a voltage comparator, selecting the lesser of the two absolute values, generating a digital angle $\alpha$, ranging between 0° to 45° from the read-only memory, producing a digital complementing angle $(90° - \alpha)$ in complement circuitry, feeding digital angles $\alpha$ and $(90° - \alpha)$ into multiplexing circuitry which produces a first angle output of $\alpha$ if the first analog input absolute value is selected and of $(90° - \alpha)$ if the second analog input absolute value is selected.

5. A method for converting two rectangular coordinate analog outputs into range and bearing digital outputs as defined in claim 4, wherein the changing of the first angle output into digital bearing output comprises the steps of:

adding the first angle output to 0° in adder circuitry if the sign comparison indicates a bearing output in the first quadrant, subtracting the first angle output from 180° in adder circuitry if the sign comparison indicates a bearing output in the second quadrant, adding the first angle output to 180° in adder circuitry if the sign comparison indicates a bearing output in the third quadrant, and subtracting the first angle output from 360° in adder circuitry if the sign comparison indicates a bearing output in the fourth quadrant.

6. A method for converting two rectangular coordinate analog inputs into range and bearing digital outputs, as defined in claim 1, comprising the further step of:

orienting the bearing coordinates to make the first quadrant correspond to the 12 o'clock to 3 o'clock quadrant, the second quadrant correspond to the 3 o'clock to 6 o'clock quadrant, the third quadrant correspond to the 6 o'clock to 9 o'clock quadrant, and the fourth quadrant correspond to the 9 o'clock to 12 o'clock quadrant.

7. An apparatus for converting two rectangular coordinate analog inputs, $x$ and $y$, into range, R, and bearing, $\theta$, polar coordinate outputs, wherein $\theta$ is located in one of four 90° quadrants, comprising:

circuit means for vectorially adding $x$ and $y$ to produce $R = \sqrt{x^2 + y^2}$; and hardwired means for determining $\theta$ comprising:

means for separately generating a magnitude value of $|x|$ and a magnitude value of $|y|$ as outputs;

means connected to the magnitude value generating means, for dividing the lesser value of $|x|$ or $|y|$ by R, an analog-to-digital converter connected to the divider means for converting the divider means output into digital form, circuitry means connected to the analog-to-digital converter for generating a first angle output located in the first quadrant, multiplexer control means, connected to the two analog inputs, for determining the quadrant in which the bearing is located by comparing the signs of $x$ and $y$, and multiplexer and adder means, having a 180° input, a 360° input, and the first angle output as inputs: for selectively combining said multiplexer and adder means inputs to produce a bearing angle output located in the quadrant determined by the multiplex control means.

8. An apparatus as defined in claim 7 further comprising:

circuitry means connected to the circuit means for vectorially adding $x$ and $y$ for converting the R output into decimal digital form, and converter circuitry means, connected to the output of the multiplexer and adder means, for generating a decimal digital bearing output.

9. An apparatus as defined in claim 7 wherein the multiplexer means further comprises:

an inhibit line input, connected from the multiplex control means for suppressing the 180° input and the 360° input when a comparison of the signs of $x$ and $y$ shows both to be positive, a first select line input, connected from the multiplex control means, for activating the 180° input when $y$ is negative and for activating the 360° input when $y$ is positive and $x$ is negative, a second select line input, connected from the multiplex control means, for properly selecting the first angle output if the multiplexer control means indicates a first or third quadrant bearing or selecting minus the first angle output if the multiplex control means indicates a second or fourth quadrant bearing.

* * * * *